United States Patent [19]

Kawatei et al.

[11] 4,449,500

[45] May 22, 1984

[54] INJECTION COMPENSATOR FOR FUEL INJECTION PUMP

[75] Inventors: Hisatsugu Kawatei; Hidetoshi Saito; Hisashi Nakamura, all of Matsuyama, Japan

[73] Assignee: Diesel Kiki Company, Ltd., Tokyo, Japan

[21] Appl. No.: 385,607

[22] Filed: Jun. 7, 1982

[30] Foreign Application Priority Data

Jun. 5, 1981 [JP] Japan ..... 56-86573

[51] Int. Cl.[3] ..... F02D 23/02

[52] U.S. Cl. ..... 123/380; 123/383; 123/503

[58] Field of Search ..... 123/383, 382, 380, 503; 417/282, 289, 294

[56] References Cited

U.S. PATENT DOCUMENTS

| | | | |
|---|---|---|---|
| 4,095,572 | 6/1978 | Scholtz | 123/383 |
| 4,228,774 | 10/1980 | Ritter et al. | 123/383 |
| 4,286,559 | 9/1981 | Ritter et al. | 123/383 |
| 4,308,834 | 1/1982 | Eheim | 123/383 |

FOREIGN PATENT DOCUMENTS

| | | | |
|---|---|---|---|
| 41429 | 4/1981 | Japan | 123/383 |
| 1446631 | 8/1976 | United Kingdom | 123/383 |
| 2067663A | 7/1981 | United Kingdom | 123/383 |

OTHER PUBLICATIONS

Straubel et al., Distributor Injection Pump, ASME Publication, 8/1979, p. 5.

*Primary Examiner*—Ira S. Lazarus
*Assistant Examiner*—Magdalen Moy
*Attorney, Agent, or Firm*—Jordan and Hamburg

[57] ABSTRACT

A diaphragm (38) controls a position of a control sleeve (14) relative to a plunger or piston (16) in response to a pressure differential between a pressure chamber (42) and a control chamber (46) which are defined by the diaphragm (38). The pressure chamber (42) is communicated to an atmospheric pressure or a boost pressure while the control chamber (46) is selectively communicated to a source of vacuum supply through a first check valve (62) and to the atmosphere through a second check valve (58). The first and second check valves open when the pressure inside the control chamber is higher and lower than a reference level, respectively, thereby maintaining the pressure within the control chamber (46) substantially at the reference level to promote an accurate control of the control sleeve (14).

5 Claims, 2 Drawing Figures

INJECTION COMPENSATOR FOR FUEL INJECTION PUMP

BACKGROUND OF THE INVENTION

The present invention relates to an apparatus associated with a fuel injection pump for compensating a quantity of fuel injection and, more particularly, to a fuel injection compensator of the type which uses a diaphragm for controlling a control sleeve of the pump in response to a variation in atmospheric pressure or in boost pressure.

Where an internal combustion engine designed for use at ordinary low altitudes is operated at high altitudes as during uphill climbing of a motor vehicle, an excessive supply of fuel occurs due to the thin air and this not only deteriorates the fuel economy but causes emission of smoke resulting in environmental pollution. A known apparatus for settling this problem employs a bellows formed of metal, a control pin having a cam section and moved by the control pin, and a follower or sensor pin displaced by the cam section to in turn adjust the position of a control sleeve.

Some of modern motor vehicles are equipped with a turbo mechanism to attain smooth acceleration. An apparatus has been proposed which adjusts the position of the control sleeve as in the apparatus mentioned above by sensing a boost pressure of a supercharger in the turbo mechanism and, when it is intensified, causing a diaphragm to move the control pin and, thereby, the sensor pin through the cam section.

However, mounting both the apparatus using the metal bellows and the apparatus using the diaphragm on a fuel injection pump renders the pump unadvantageously bulky, heavy and quite intricate in construction.

SUMMARY OF THE INVENTION

In a fuel injection pump including a plunger or piston, a control sleeve movably coupled over the plunger, and a tension lever rotatable about a pin in driving connection with the control sleeve, an injection compensating apparatus embodying the present invention comprises a housing mounted on the pump, a pressure sensitive member dividing the interior of the housing into a first chamber communicated to variable atmospheric and boost pressures and a second chamber, and a cam and follower mechanism for operative connection between the pressure sensitive member and the tension lever. A constant pressure maintaining device is provided for maintaining a pressure into the second chamber at a substantially constant reference level. The constant pressure maintaining device comprises a first check valve and a second check valve through which the second chamber is communicated to a source of vacuum supply and to the atmosphere, respectively. The first check valve opens when a pressure in the second chamber is higher than the reference level while the second check valve opens when the pressure is lower than the reference level. Therefore, a position of the control sleeve is controlled by the pressure sensitive member through the cam and follower mechanism and the tension lever in response to a pressure differential between the first and second chambers.

In accordance with the present invention, a diaphragm controls a position of a control sleeve relative to a plunger in response to a pressure differential between a pressure chamber and a control chamber which are defined by the diaphragm. The pressure chamber is communicated to an atmospheric pressure or a boost pressure while the control chamber is selectively communicated to a source of vacuum supply through a first check valve and to the atmosphere through a second check valve. The first and second check valves open when the pressure inside the control chamber is higher and lower than a reference level, respectively, thereby maintaining the pressure within the control chamber substantially at the reference level to promote an accurate control of the control sleeve.

It is an object of the present invention to provide an injection compensating apparatus for a fuel injection pump which can compensate a position of the control sleeve accurately against both an atmospheric pressure and a boost pressure without affecting the dimensions, weight or structure of the pump.

It is another object of the present invention to provide an injection compensating apparatus for a fuel injection pump which promotes efficient combustion in an internal combustion engine.

It is another object of the present invention to provide a generally improved injection compensating apparatus for a fuel injection pump.

Other objects, together with the foregoing, are attained in the embodiments described in the following description and illustrated in the accompanying drawings.

DESCRIPTION OF THE PREFERRED EMBODIMENT

While the injection compensator for a fuel injection pump of the present invention is susceptible of numerous physical embodiments, depending upon the environment and requirements of use, substantial numbers of the herein shown and described embodiment have been made, tested and used, and all have performed in an eminently satisfactory manner.

Figure 1:
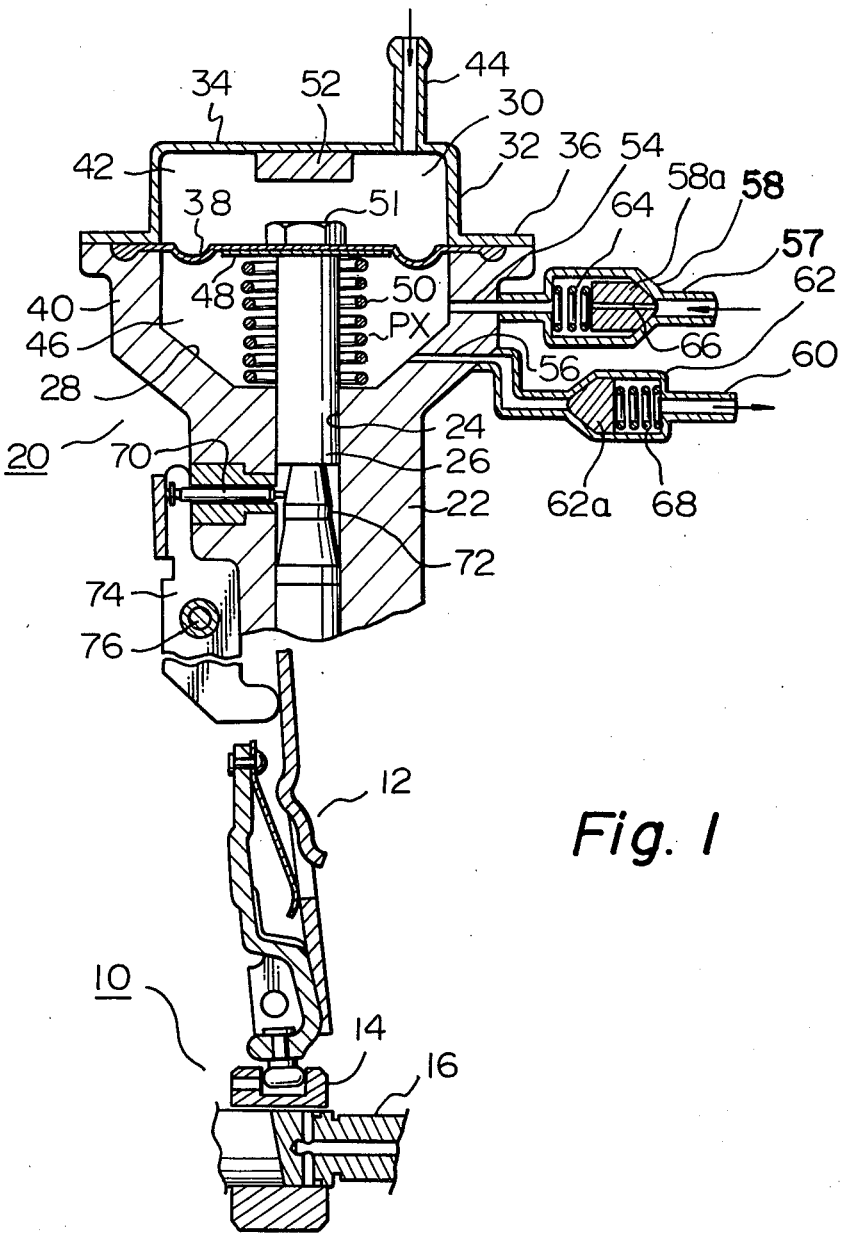
FIG. 1 is a section of an injection compensating apparatus for a fuel injection pump embodying the present invention.

Referring to FIG. 1 of the drawings, a fuel injection pump includes as usual a fuel control mechanism generally designated by the reference numeral 10. In the fuel control mechanism 10, flyweights (not shown) are movable to displace a governor sleeve (not shown) which in turn rotates a tension lever 12 against the action of a governor spring (not shown). The tension lever 12 is rotatably mounted to a housing of the pump. The tension lever 12 then moves a control sleeve 14 in which a plunger or piston 16 is coupled, thereby controlling the quantity of fuel supply from the plunger 16 to an engine. In accordance with the present invention, the tension lever 12 is controlled by the injection compensator which is generally denoted by the reference numeral 20.

The compensator 20 has a housing 22 formed with a bore 24 in which a control pin 26 is axially slidable. The end of the housing 22 at which the control pin 26 protrudes is recessed as at 28 to define a chamber 30 in cooperation with a cylindrical cover 32. The cover 32 has a bottom 34 and is connected along an annular flange 36 thereof to the housing 22. A diaphragm 38 is retained along its peripheral edge between the flange 36 of the cover 32 and the end of a side wall 40 of the housing 22 which defines the recess 28. The chamber 30 is divided by the diaphragm 38 into a pressure chamber 42 communicated to a supercharger via a passageway 44 and a control chamber 46. A spring seat 48 is carried on that surface of the diaphragm 38 which faces the control chamber 46. A spring 50 is wound around the control pin 26 to constantly urge the spring seat 48 and, therefore, the control pin 26 integral therewith toward the bottom 34 of the cover 32. The movement of the control pin 26 in this direction is limited when its end 51 abuts against a stop 52 which is mounted on the bottom 34 of the cover 32 inside the pressure chamber 42.

The side wall 40 of the housing 22 is formed with passageway 54 and 56 therethroughout. The passageway 54 communicates the control chamber 46 to the atmosphere through a piping 57 in which a check valve 58 is positioned. The passageway 56, on the other hand, communicates the control chamber 46 to a vacuum pump of a vehicle through a piping 60 in which a check valve 62 is positioned. The vacuum pump may be constituted by a compressor which provides for a pneumatic brake of the vehicle. The check valve 58 has a valve member **58*a* which is movable to open the valve against the force of a spring 64 when the pressure Px inside the control chamber 46 drops beyond a predetermined reference level, thereby introducing atmospheric pressure into the control chamber 46. The pressure drop within the control chamber 46 is thus limited to a constant value. The valve member 58*a*, at the same time, is formed with a narrow passageway 66 for providing constant communication of the control chamber 46 with the atmosphere. The check valve 62 has a valve member 62*a* which is movable to open the valve against the force of a spring 68 when the pressure Px in the control chamber 46** rises beyond the reference level, thereby lowering the pressure Px.

The preloads of the springs 64 and 68 are so selected as to maintain the pressure Px inside the control chamber 46 substantially at 400 mmHg, for example. Then, the check valve 58 will be opened upon drop of the pressure Px beyond 400 mmHg while the check valve 68 will be opened upon rise of the pressure Px beyond 400 mmHg.

Figure 2:
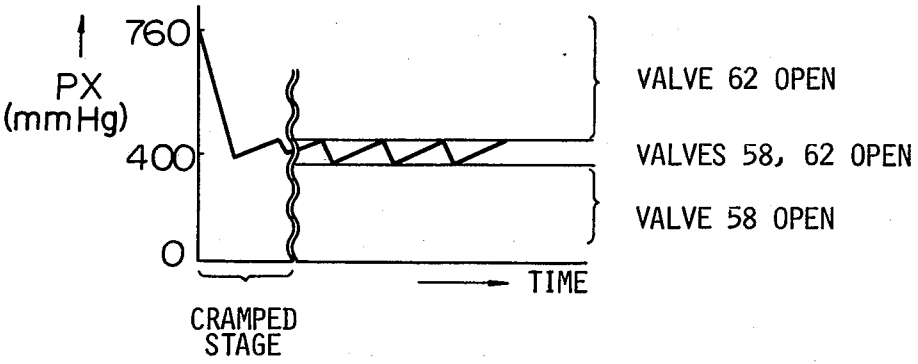
FIG. 2 is a graph representing an operation of the apparatus with respect to time and pressure.

When the engine of the motor vehicle is cranked, the pressure Px in the control chamber 46 is about 760 mmHg as long as the vehicle is at an altitude of zero meter. This pressure Px is higher than the predetermined level, 400 mmHg, so that the check valve 68 is opened by the vacuum from the vacuum pump causing a progressive drop of the pressure Px. Though the pressure Px is allowed to rise due to the atmospheric pressure communicated into the control chamber 46 via the narrow passageway 66 of the valve member **58*a*, the rate of the elevation is negligible compared to the rate of the pressure drop caused by the vacuum pump. As the pressure Px is lowered beyond 400 mmHg, the check valve 58 opens to allow no further pressure drop. The check valve 62 closes when the pressure Px reaches the reference level. Thereafter, when the pressure Px is progressively elevated due to the communication of atmospheric air through the narrow passageway 66 beyond 400 mmHg, the check valve 62 opens again so that the pressure Px is lowered down to 400 mmHg. In this way, while the motor vehicle is operated, the pressure inside the control chamber 46 is maintained approximately at 400 mmHg as shown in FIG. 2 by the repeated control actions of the check valves 58 and 62**.

When the motor vehicle is accelerated to intensify the boost pressure communicated from the supercharger to the pressure chamber 42, the diaphragm 38 is urged against the force of the spring 50 due to the constant pressure Px inside the control chamber 46. Then, the control pin 26 is moved together with the diaphragm 38 deeper into the bore 24 of the housing 22, whereby a sensor pin 70 is cammed to move inwardly by a tapered section 72 of the control pin 26. The sensor pin 70 in turn rotates a lever 74 clockwise about a pin 76 and, thereby, the tension lever 12 counterclockwise. As a result, the control sleeve 14 is moved in a direction for increasing the quantity of fuel injection.

When the vehicle runs from a low altitude to a high altitude as during uphill climbing, the pressure inside the pressure chamber 42 becomes lower due to the communication of the passageway 44 of the atmosphere through the supercharger. The spring 50 then urges the diaphragm 38 toward the bottom 34 of the cover 32 accompanied by the control pin 26. The sensor pin 70 is now cammed in the opposite direction causing the lever 74 into a counterclockwise movement about the pin 76 and, therefore, the tension lever into a clockwise movement. This controls the control sleeve 14 to the other direction for suppressing the quantity of fuel injection.

In summary, it will be seen that the present invention provides a fuel injection compensating apparatus which enhances the combustion efficiency of an internal combustion engine by controlling a quantity of injection from a fuel injection pump in response to a change of boost pressure or that of atmospheric pressure. As will be recalled, this is because a diaphragm is movable in accordance with a difference between a substantially constant pressure acting on one side thereof and a variable pressure acting on the other side, which may be the boost pressure or the atmospheric pressure. The apparatus is simple in construction and small in size due to the use of a diaphragm as a pressure sensitive member. Additionally, applying such an apparatus to a fuel injection pump simplifies the structure of the pump itself.

Various modifications will become possible for those skilled in the art after receiving the teachings of the present disclosure without departing from the scope thereof. For example, a reference pressure higher or lower than 400 mmHg may be designed for the control chamber 46. The source of vacuum supply for lowering the pressure inside the control chamber 46 may be constituted by a vacuum pump for exclusive use mounted on a vehicle, instead of the compressor of the pneumatic brake. If desired, the check valve 58 may be replaced by an air flow control member which is disposed in the passageway 54 and capable of regulating the amount of restriction of leakage.

What is claimed is:

1. An injection compensating apparatus for a fuel injection pump which includes a plunger or piston, a control sleeve movably coupled over the plunger, and a tension lever rotatably about a pin in operative connection with the control sleeve comprising:

a housing mounted on the pump;

a pressure sensitive member dividing the interior of the housing into a first chamber and a second chamber, the first chamber being communicated to variable atmospheric and boost pressures;

constant pressure maintaining means for maintaining a pressure inside the second chamber at a substantially constant reference level;

the constant pressure maintaining means comprising a first check valve and a second check valve through which the second chamber is communicated to a source of vacuum supply and to the atmosphere, respectively, the first check valve opening when a pressure in the second chamber is higher than the reference level while the second check valve opening when the pressure is lower than the reference level; and a cam and follower mechanism for operative connection between the pressure sensitive member and the tension lever;

whereby the pressure sensitive member controls a position of the control sleeve through the cam and follower mechanism and the tension lever in response to a pressure differential between the first and second chambers.

2. An apparatus as claimed in claim 1, in which the pressure sensitive member comprises a flexible diaphragm retained along a peripheral edge thereof by the housing.

3. An apparatus as claimed in claim 1, in which the reference pressure level in the second chamber is selected to be 400 mmHg.

4. An apparatus as claimed in claim 1, in which the source of vacuum supply comprises a compressor of a pneumatic brake installed in a motor vehicle.

5. An apparatus as claimed in claim 1, in which the source of vacuum supply comprises a vacuum pump mounted on a motor vehicle for exclusive use.

* * * * *